US005100341A

United States Patent [19]

Czyz et al.

[11] Patent Number: 5,100,341

[45] Date of Patent: Mar. 31, 1992

[54] ELECTRICAL CONNECTOR

[75] Inventors: Anthony Czyz, Chicago; Robert A. Miller, St. Charles, both of Ill.

[73] Assignee: Molex Incorporated, Lisle, Ill.

[21] Appl. No.: 663,336

[22] Filed: Mar. 1, 1991

[51] Int. Cl.[5] ..... H01R 13/56

[52] U.S. Cl. ..... 439/447; 439/320

[58] Field of Search ..... 439/447–449, 439/310, 315, 320

[56] References Cited

U.S. PATENT DOCUMENTS

| | | | |
|---|---|---|---|
| 3,497,608 | 2/1970 | Elliott et al. | 439/447 X |
| 3,816,641 | 6/1974 | Iversen | 439/320 X |
| 3,960,428 | 6/1976 | Naus et al. | 439/315 |
| 3,986,765 | 10/1976 | Shaffer et al. | 439/447 X |

*Primary Examiner*—Eugene F. Desmond

*Attorney, Agent, or Firm*—Stephen Z. Weiss; Charles S. Cohen; A. A. Tirva

[57] ABSTRACT

An electrical connector for terminating the conductors of an electrical cable and including a terminal receiving body having a front mating end and a rear conductor receiving end. A flexible strain relief boot is disposed about at least a portion of the cable at the rear conductor receiving end of the terminal receiving body. The strain relief boot includes a plurality of discrete recesses which progressively increase in size in a rearward direction to increase the flexibility of the strain relief boot progressively toward the rear thereof. The discrete recesses also are more closely spaced in a progressive manner rearwardly of the boot. A coupling ring surrounds the terminal receiving body, and a visual indicating ring is hidden by the coupling ring when in an inactive position, the visual indicating ring being exposed when the coupling ring is in a mating position thereby to visually indicate a mating condition of the connector and the visual indicating ring providing for omnidirectional visualization thereof. The coupling ring extends rearwardly beyond a termination interface between the terminal receiving body and the conductors to provide a rigidifying support thereabout.

6 Claims, 2 Drawing Sheets

ELECTRICAL CONNECTOR

FIELD OF THE INVENTION

This invention generally relates to the art of electrical connectors and, particularly, to various features of an electrical connector, such as visual indicating means and strain relief means for the conductor terminations of an electrical cable and the cable itself.

BACKGROUND OF THE INVENTION

Electrical connectors which are designed for high current applications are made in a variety of configurations so that a male plug is mateable with a female receptacle. Most often, such connectors are made in a circular configuration, and one connector includes a coupling ring for mating the one connector with the mateable connector. The coupling ring may be of a screw-thread type or have a bayonet coupling configuration.

Various desired features and various problems are encountered in designing electrical connectors of the character described.

For instance, with high current applications, it is desirable to provide a visual indicating means which indicates to a user that the connector is fully mated with its complementary connector. For instance, U.S. Pat. Nos. 4,443,052; 4,497,530 and 4,534,607 are representative of the prior art and all show one form or another of a visual indicating means for the purpose described above. The visual indicating means of the prior art as represented by these patents have distinct disadvantages. For instance, the indicating means are difficult to see from a distance. Of equal or more significance is that the visual indicating means is not omnidirectional in that an operator must be looking at the connector from a specific vantage point in order to see the visual indicating means. This is disadvantageous particularly with circular connectors which could be mated in different angular orientations.

Another problem with connectors of the character described is in protecting the termination interface between the interior terminals and the conductors from the electrical cable. Such connectors are exposed to relatively large forces during mating, unmating and handling in comparison to smaller electronic-type connectors. Compounding this problem is the fact that many such connectors include a housing portion and/or a flexible boot extending rearwardly from the termination interface and which can be bent or disformed. This invention is directed to solving this problem by a very simple means of elongating the coupling ring to extend rearwardly beyond this interface.

Still another problem with electrical connectors of the character described is in providing an appropriate strain relief means for the electrical cable itself. Again, keeping in mind the "heavy" use of such connectors, either the strain relief means is too flexible for affording adequate protection for the cable or it is too rigid to afford an acceptable range of bending of the cable. This invention is directed to solving this problem by providing a strain relief means or boot which is provided with means for progressively varying the bending capabilities of the boot rearwardly of the connector.

SUMMARY OF THE INVENTION

An object, therefore, of the invention is to provide a new and improved electrical connector of the character described and incorporating novel features for enhancing the usability of the connector and protecting the terminations and the cable terminated to the connector.

In the exemplary embodiment of the invention, an electrical connector is provided for terminating the conductors of an electrical cable. Generally, the connector includes terminal receiving means including a front mating end and a rear conductor receiving end. Flexible strain relief means are provided about at least a portion of the cable at the rear conductor receiving end of the terminal receiving means. The strain relief means include a plurality of discrete recesses which progressively increase in size in a rearward direction to increase the flexibility of the strain relief means progressively toward the rear thereof.

As disclosed herein, the flexible strain relief means is provided in the form of a flexible boot surrounding the cable at the rear of the connector. The boot may be of a constant cross-section along at least the length thereof which includes the discrete recesses, and the recesses are formed by through openings in the boot. To further progressively increase the flexibility of the boot, the through openings may be more closely spaced in a progressive manner toward the rear of the boot.

Another feature of the invention is to provide visual indicating means on the terminal receiving means to indicate a mating condition of the connector. The connector disclosed herein is a circular connector with a coupling ring about the terminal receiving means. The coupling ring is movable longitudinally between an inactive position to a mating position for coupling the connector to a complimentary mating connector. The visual indicating means is located on the terminal receiving means at a position to be hidden by the coupling ring when in its inactive position and to be exposed when the coupling ring is in its mating position, thereby to visually indicate a mating condition of the connector. The invention contemplates that the visual indicating means extend substantially entirely about the terminal receiving means to provide for omnidirectional visualization thereof.

As disclosed herein, the visual indicating means comprise an indicating ring circumscribing the terminal receiving means. Preferably, the indicating ring is of a bright color in contrast to that of the terminal receiving means. With the ring circumscribing the terminal receiving means, an operator can see whether or not the connector is fully mated from any vantage point 360° about the connector.

In the exemplary embodiment of the invention, the flexible boot which forms the strain relief means for the connector is overmolded about the rear conductor receiving end of the terminal receiving means. The conductors from an electrical cable are terminated to terminals back-loaded into the terminal receiving means. Consequently, should there by any excess bending of the overmolded boot, the terminations of the conductors with the terminals could be disturbed. A further feature of the invention contemplates that the coupling ring be made of a length to extend rearwardly about the termination interfaces between the conductors and the terminals to provide surrounding support and protection in that area. The extended-length coupling ring also provides a greater surface for manual gripping by an operator during mating of the connector with a complementary connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
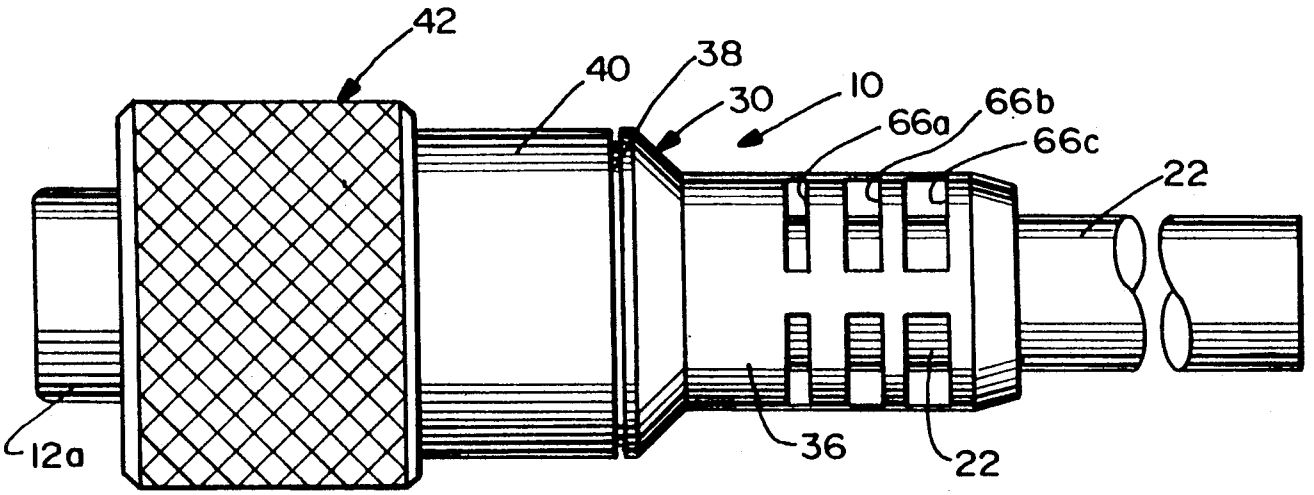
FIG. 1 is an elevational view of an electrical connector incorporating the concepts of the invention, with the coupling ring of the connector in a rear, inactive position.

Referring to the drawings in greater detail, the features of this invention are incorporated in an electrical connector, generally designated 10, of a circular configuration. The connector shown is a male plug connector for mating with a complementary female receptacle connector (not shown) as is known in the art.

Figure 2:
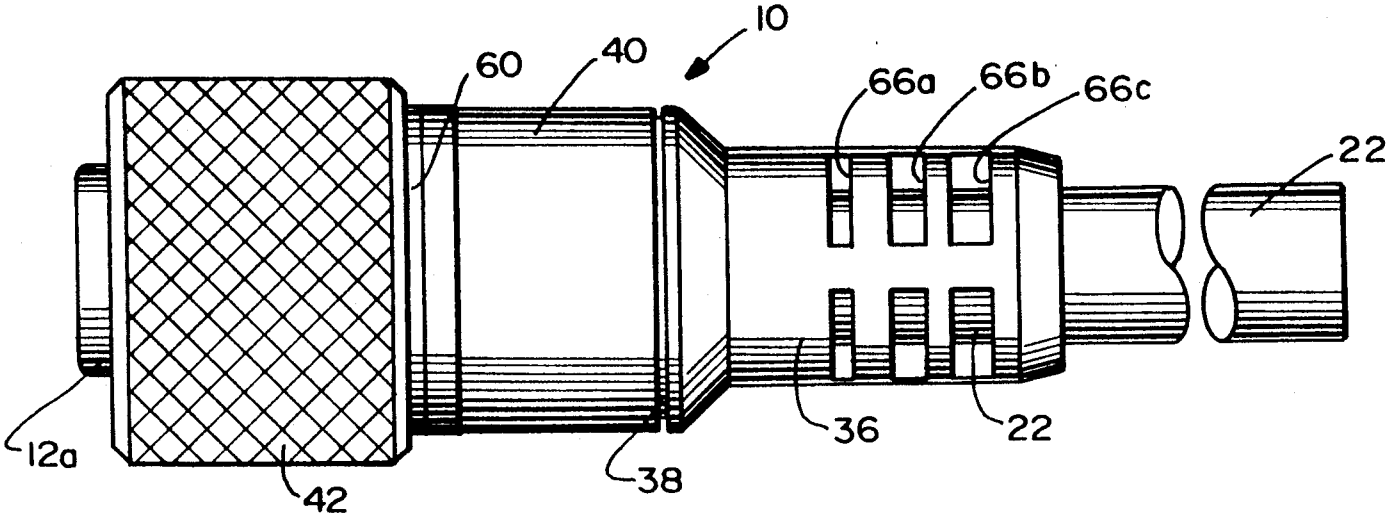
FIG. 2 is a fragmented elevational view similar to that of FIG. 1, but with the coupling ring moved forward to its mating position.
Figure 3:
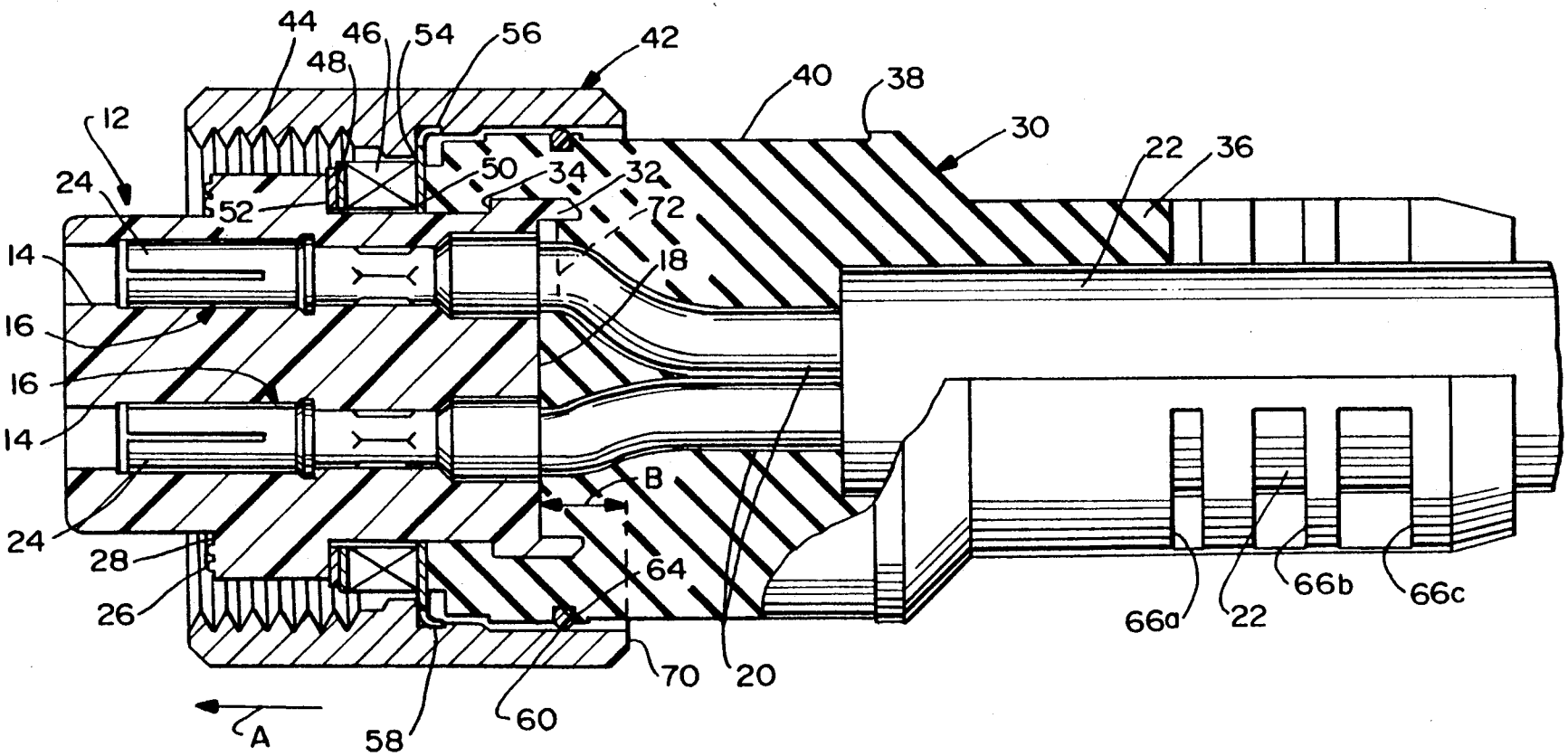
FIG. 3 is a longitudinal or axial fragmented section, on an enlarged scale, of the connector in the condition of FIG. 1.

Connector 10 includes a terminal receiving means in the form of a plug body, generally designated 12 in FIG. 3, and including a forward plug portion 12*a* which is visible in FIGS. 1 and 2. Plug body 12 includes a plurality of through passages 14 (FIG. 3) extending longitudinally or axially therethrough for respectively receiving a plurality of terminals or contacts, generally designated 16. The terminals extend rearwardly to an interface 18 at the rear of body 12 and are terminated to a plurality of conductors 20 of a multiconductor electrical cable 22. Plug portion 12*a* defines a front mating end of body 12, and interface 18 defines a rear conductor receiving end of the body. Terminal pins of the mating connector are inserted into the front of passages 14 and into receptacle contact portions 24 of terminals 16. Body 12 is fabricated of conventional, relatively rigid dielectric plastic material. The complementary connector has a similar dielectric body which, when mated to connector 10, abuts a seal, generally designated 26 (FIG. 3) on a forwardly facing abutment shoulder 28 of body 12. The seal is formed by a pair of concentric rings molded integrally with and projecting forwardly of shoulder 28.

A boot, generally designated 30, is overmolded about the rear conductor receiving end of body 12. To that end, the body has an annular, rearwardly projecting flange 32 and a forwardly projecting annular shoulder 34 for "capturing" the surrounding overmolded material of boot 30. The material may be of a relatively flexible rubber-like composition. Boot 30 terminates in a circular, rearwardly projecting strain relief portion 36 of substantially constant cross-section. Boot 30 may have a circumscribing recess 38 for receiving a cylindrical name plate 40 which may contain such information as the specifications of the connector.

A cylindrical coupling ring, generally designated 42, surrounds substantially the entirety of plug body 12 except for a forwardly projecting portion of plug portion 12*a*, as seen in FIGS. 1 and 2. The coupling ring is freely rotatable about plug body 12 and boot 30, and the ring includes interior coupling means in the form of internal screw threads 44 for threadably engaging external screw threads on the complementary mating connector, as is known in the art. The coupling means equally could include a bayonet-type coupling means, also as is known in the art of circular connectors. Generally, coupling ring 42 is movable longitudinally of connector 10 between an inactive position shown in FIG. 1 and an extended or mating position shown in FIG. 2. More particularly, a spring means 46, which can take the form of a wave spring, is sandwiched between a rearwardly facing shoulder 48 of plug body 12 and a forwardly facing surface 50 of overmolded boot 30. Antifriction washers 52 are disposed between the front end of spring 46 and shoulder 48. A coupling ring lock washer 54 is disposed between the rear end of spring 46 and shoulder 50. Lock washer 54 has a peripheral, rearwardly projecting flange 56 which seats in an interior annular recess 58 of coupling ring 42. Therefore, the lock washer is keyed to and movable with the coupling ring.

From the forgoing, it can be understood that when coupling ring 42 is threaded onto the complementary connector which, in turn, abuts seal 26 on plug body 12, the coupling ring will move forwardly in the direction of arrow "A" (FIG. 3) compressing spring 46. When uncoupled, the spring biases the coupling ring rearwardly, opposite the direction of arrow "A", to the inactive position of the coupling ring as shown in FIGS. 1 and 3.

A feature of the invention is the provision of visual indicating means on boot 30 at a position to be hidden by coupling ring 42 when in its inactive position (FIGS. 1 and 3) and to be exposed when the coupling ring is in its fully mated position (FIG. 2).

More particularly, a circular ring of a bright color, in contrast to the surrounding components of the connector, is provided whereby the ring can be visualized omnidirectionally about the connector. In FIG. 2, the ring is shown as a stripe 60 about boot 30. The stripe may be painted on the boot or applied as a tape or other appropriate means of application. In FIG. 3, the visual indicating means is shown as an O-ring 62 disposed in a circular recess 64 circumscribing boot 30. Again, O-ring 62 preferably is of a bright color to facilitate ready visualization thereof.

In operation, and as seen in FIGS. 1 and 3, when coupling ring 42 is in its rear or inactive position as biased thereto by spring 46, stripe 60 (FIG. 2) or O-ring 62 (FIG. 3) is completely hidden by the rear end of the coupling ring. When the coupling ring is threaded onto the mating connector, the coupling ring moves forwardly in the direction of arrow "A" (FIG. 3) to a fully mated position as shown in FIG. 2. In this position, it can be seen that the visual indicating means or ring, whether it be stripe 60 or O-ring 62, is exposed by the coupling ring. Since the visual indicating means extends 360° about the connector, it provides omnidirectional visualization from any vantage point about the connector.

Another feature of the invention is the provision of strain relief means which provides progressively increasing flexibility in a direction rearwardly of the connector about electrical cable 22. More particularly, a plurality of recesses 66*a*, 66*b* and 66*c* are formed in strain relief portion 36 of boot 30. In the illustrated embodiment, the recesses are in the form of through openings of generally rectangular configuration in a direction transverse to cable 22. The cable can be seen through the openings in FIG. 1 and the bottom of FIG. 3.

The invention contemplates that openings 66*a*–66*c* progressively increase in size in a rearward direction as shown in the drawings. By progressively increasing the size of the openings, the flexibility of strain relief portion 36 of boot 30, likewise, increases in flexibility progressively toward the rear thereof along cable 22. In other words, it can be seen that rear opening 66*c* is larger than middle opening 66*b* which, in turn, is larger than opening 66*a*. Therefore, there will be more flexibility toward the rear distal end of strain relief portion 36 than forwardly thereof.

The degree of progression of flexibility along strain relief portion 36 further can be enhanced by varying the spacing between openings 66*a*–66*c*. Specifically, it can be seen that rear opening 66*c* is closer to middle opening 66*b* than is the middle opening to front opening 66*a*. Consequently, there is more overmolded material in a forward direction which, inversely, increases the flexibility of strain relief portion 36 in a rearward direction. With the progressively increasing flexibility in a rearward direction, cable 22, under transverse stresses, will absorb strain within the area of the strain relief portion 36 in a more uniform manner and prevent kinking or otherwise abruptly disturbing the orientation of conductors 20 within the cable.

The invention also contemplates providing protection in the area of terminals 16 supported within plug body 12. This is a critical area with the increasing trend to overmolding boots or rear body portions to a more rigid terminal receiving body portion in these types of connectors. Should there be severe transverse stresses on the rear end of the connector, the termination interface between the conductors and the terminals can be disturbed even though there is a considerable bulk of overmolded material of boot 30 surrounding this interface.

In order to solve the problem described immediately above, the invention contemplates a simple solution of dimensioning coupling ring 42 of a sufficient front-to-rear length so that the coupling ring projects rearwardly beyond interface 18 significantly when in its inactive position as shown in FIG. 3. In other words, it can be seen that the rear end 70 of the coupling ring projects beyond interface 18 a distance represented by double-headed arrow "B". Even when in its mating position, the coupling ring still covers interface 18 as represented by dashed line 72. In any event, in either of its positions, coupling ring 42 does not move forwardly of interface 18. Since the coupling ring, conventionally, is fabricated of rigid metal or plastic material, the coupling ring provides a surrounding supporting means in this critical interface area. An additional benefit to extending the length of the coupling ring is to provide a greater surface area for grasping and rotating by an operator.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for terminating the conductors of an electrical cable, including a terminal receiving body with a front mating end and a rear conductor receiving end, a coupling ring about the terminal receiving body and movable longitudinally between an inactive position and a mating position for coupling the connector to a complementary mating connector, and a flexible strain relief means about at least a portion of the cable at the rear conductor receiving end of the terminal receiving body, said strain relief means having a plurality of spaced apart recesses, each recess having a width and the centerline of each recess being spaced apart substantially the same distance the improvement comprising:

the strain relief means having a ratio between the centerline spacing of the recesses and the recess width, such ratio progressively decreasing toward the rear end of the connector to increase the flexibility of the strain relief progressively toward the rear end thereof;

visual indicating means on the connector at a position to be hidden by the coupling ring when in its inactive position and to be exposed when the coupling ring is in its mating position, to visually indicate a mated condition of the connector, the visual indicating means extending substantially entirely about the terminal receiving body to provide for omnidirectional visualization thereof;

and the coupling ring being of a length to extend substantially beyond the rear conductor receiving end of the terminal receiving body when the coupling ring is in its rear inactive position.

2. The electrical connector of the claim 1 wherein said recess widths progressively increase in size rearwardly of the strain relief means.

3. The electrical connector of claim 1 wherein said recesses comprise through openings in the strain relief means.

4. The electrical connector of claim 1 wherein said strain relief means comprise a flexible boot surrounding the cable at the rear of the connector.

5. The electrical connector of claim 4 wherein said boot is of a constant cross-section along at least a length thereof which includes said recesses.

6. The electrical connector of claim 4 wherein said recesses comprise through openings in the boot.

* * * * *